US005213015A

United States Patent [19]

Disston, Jr.

[11] Patent Number: 5,213,015

[45] Date of Patent: May 25, 1993

[54] VARIABLE NUT DRIVER

[76] Inventor: Horace C. Disston, Jr., 217 S. Hurffville Rd., Deptford, N.J. 08096

[21] Appl. No.: 770,361

[22] Filed: Oct. 3, 1991

[51] Int. Cl.[5] ..... B25B 13/32

[52] U.S. Cl. ..... 81/90.9; 81/113; 81/115; 279/52

[58] Field of Search ..... 81/90.1-90.9, 81/91.3, 111-116; 279/42, 52, 56

[56] References Cited

U.S. PATENT DOCUMENTS

| | | | |
|---|---|---|---|
| 816,777 | 4/1906 | Brown | 81/112 U X |
| 957,760 | 5/1910 | Fray | 81/113 |
| 1,114,653 | 10/1914 | Starin | 279/52 |
| 2,390,034 | 11/1945 | Walker | 81/112 |
| 3,339,439 | 9/1967 | Van Dalen et al. | 81/112 |
| 3,373,639 | 3/1968 | Van Dalen et al. | 81/112 |

*Primary Examiner*—D. S. Meislin
*Attorney, Agent, or Firm*—Norman E. Lehrer

[57] ABSTRACT

A variable nut driver includes a multi-fingered collet with individual jaw faces at the free ends of the fingers and a ring connecting together all of the fingers at their other ends. The collet is contained within a tubular member secured to a handle. A flat thread follower within the collet has projections which extend between the fingers and through opposing elongated slots in the tubular member. The projections engage the inner thread of a rotatable sleeve surrounding the tubular member and collet at axially displaced positions. Rotation of the sleeve moves the thread follower and collet axially forward or back. As the collet is moved back the jaw faces extending past the open end of the tubular member are cammed toward each other. Conversely, as the collet is moved forward, the jaw faces move away from each other. Rearward movement of the sleeve is restricted by the position of the handle relative to the tubular member. This prevents the sleeve from becoming disengaged from the thread follower.

10 Claims, 2 Drawing Sheets

VARIABLE NUT DRIVER

BACKGROUND OF THE INVENTION

The present invention is directed toward a variable nut driver and more particularly toward such a device wherein the jaws of a split collet can be moved toward or away from each other by rotating a sleeve carried by the driver.

The variable nut driver described herein is an improvement over the devices shown in U.S. Pat. Nos. 3,339,439 and 3,373,639. These prior patents describe an adjustable socket wrench having a spring loaded split collet held within a tubular closure member. The jaws at the free end of the collet are normally biased away from each other. However, as a forward force is asserted on the handle, the collet closes to thereby grasp a nut or hexagonal screw head or the like.

While devices made in accordance with these two prior patents met with some success, they also suffer from a significant deficiency. These devices work well when tightening a screw since this requires forward pressure and the jaws close when a forward force is applied to the driver handle. However, when it is desired to loosen or remove a screw, forward pressure must be maintained on the screw in order to keep the jaws closed. This can make it difficult to unscrew the screw. It is also impossible to hold a screw or nut with the driver before it is applied to its proper position or after it has been removed.

Subsequent to the drivers described in U.S. Pat. Nos. 3,339,439 and 3,373,639, a tool was developed in an attempt to obviate the problems encountered with these patented devices. This improved tool, known as a Drive-All, was marketed in 1974 and 1975 by Seaboard Tools of Cherry Hill, N.J. The Drive-All also included a split collet. However, rather than requiring a forward spring force to open and close the collet, the device was provided with a sleeve member having an internal thread which surrounded a portion of the collet. The collet was provided with a pin which extended radially from the same and which engaged the thread. Rotation of the sleeve caused the pin and, therefore the collet, to move axially.

Although the Drive-All device did solve some of the problems of the previously described patented devices, it still had some problems. First, it was somewhat difficult to assemble. Secondly, because only one portion of the pin at any one time engaged the internal thread, a torquing action was being applied which frequently caused the pin to jam. Even further, because of the arrangement of the sleeve around the collet and shank portion of the driver, it was possible to turn the sleeve so far that it became disengaged from the pin thereby causing the tool to become disassembled in use.

SUMMARY OF THE INVENTION

The instant invention is designed to overcome all of the problems of the prior art described above. The variable nut driver of the invention includes a multi-fingered collet with individual jaw faces at the free ends of the fingers and a ring connecting together all of the fingers at their other ends. The collet is contained within a tubular member secured to a handle. A flat thread follower within the collet has projections which extend between the fingers and through opposing elongated slots in the tubular member. The projections engage the inner thread of a rotatable sleeve surrounding the tubular member and collet at axially displaced positions. Rotation of the sleeve moves the thread follower and collet axially forward or back. As the collet is moved back, the jaw faces extending past the open end of the tubular member are cammed toward each other. Conversely, as the collet is moved forward, the jaw faces move away from each other. - TM Rearward movement of the sleeve is restricted by the position of the handle relative to the tubular member. This prevents the sleeve from becoming disengaged from the thread follower.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
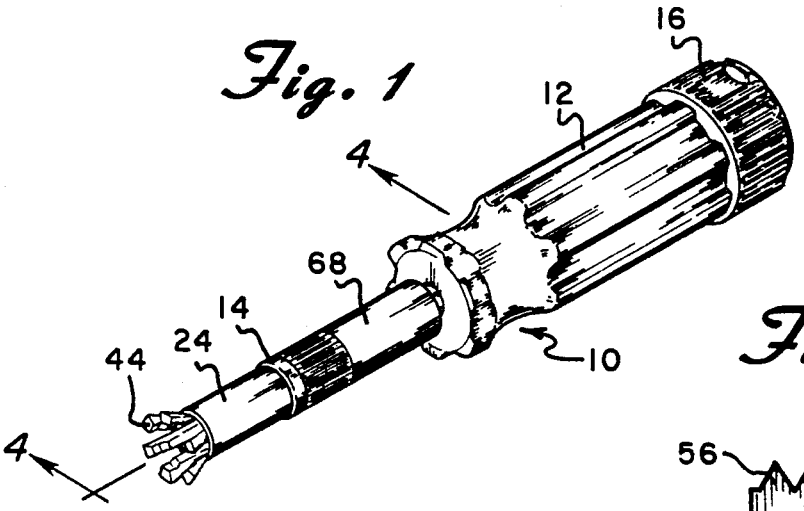
FIG. 1 is a perspective view of a variable nut driver in accordance with the invention.
Figure 3:
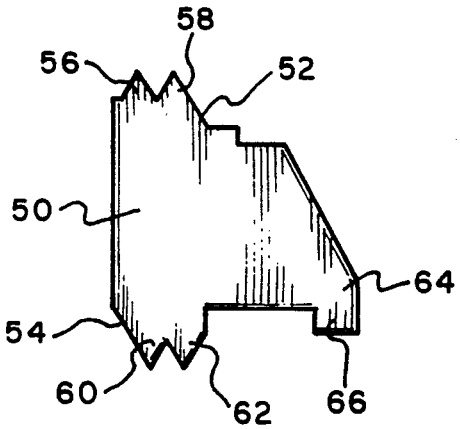
FIG. 3 is a detailed view of the thread follower utilized with the invention.

Referring now to the drawings in detail wherein like reference numerals have been used throughout the various figures to designate like elements, there is shown in FIG. 1 a variable nut driver constructed in accordance with the principles of the present invention and designated generally as 10. Driver 10 is comprised essentially of two major portions, a handle 12 and the driver mechanism 14. Handle 12 may be of substantially any conventional type and preferably has a hollow center and a cap 16 at the open end thereof which allows access to the hollow handle for storing screwdriver or nut driver bits or the like.

Figure 2:
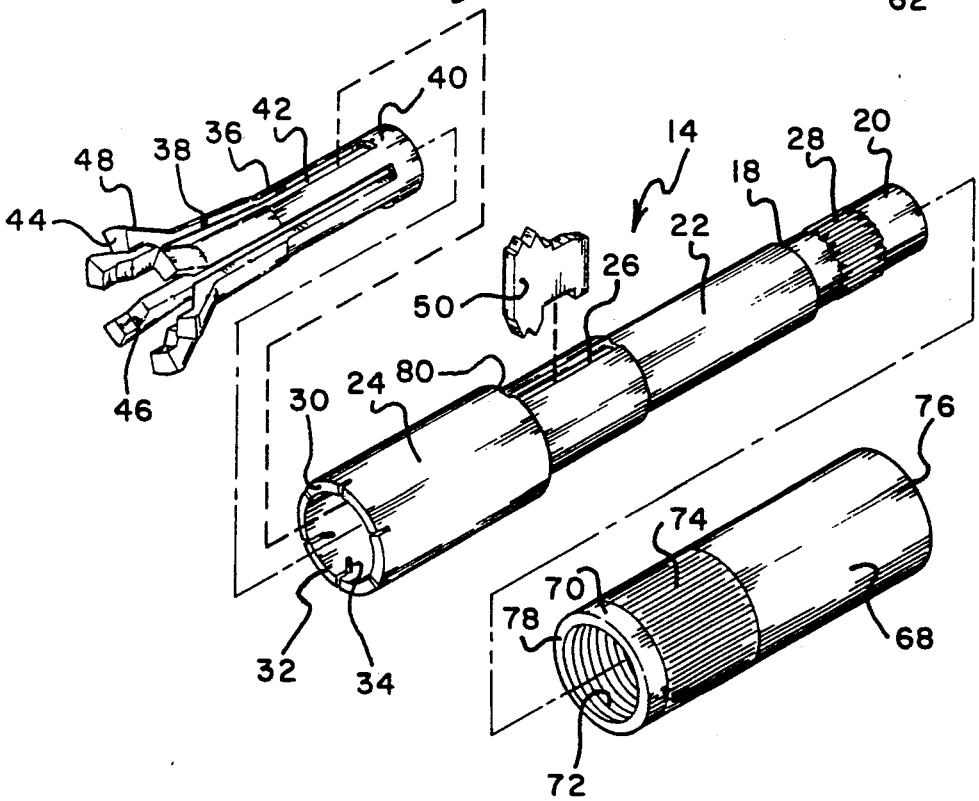
FIG. 2 is an exploded perspective view showing the manner in which the various parts of the device shown in FIG. 1 are assembled.

The driver mechanism 14 is best illustrated in FIG. 2. It includes a closure member 18 having a rear shank portion 20 and intermediate tubular portion 22 and a forward tubular portion 24. The intermediate tubular portion 22 includes a pair of opposed axially extending elongated slots in the wall thereof. Only one such slot 26 can be seen in FIG. 2. It will be understood, however, that a substantially identical slot is located 180° at the bottom of the intermediate tubular portion.

The rear shank portion 20 includes a knurled area 28 on the surface thereof. The free rear end of the shank portion 20 is inserted into an appropriate opening in the handle 12 and is held in place by the knurled section 28 in the known manner. The forward open end 30 of the forward tubular member 24 has an inner edge 32 which, as will be more clearly apparent hereinafter, functions as a cam surface. A plurality of tabs such as shown at 34 are punched from the forward edge 30 of the forward tubular member 24 and extend radially inwardly around the perimeter thereof.

A collet member 36 adapted to be inserted into the tubular portions 22 and 24 includes a plurality of elongated fingers such as shown at 38. In the preferred embodiment of the invention, there are six such fingers, all of which are connected together at one end thereof by way of a cylindrical ring 40. The fingers 38 are equally spaced around the collet 36 and are separated from each other with a space 42 interposed between adjacent fingers.

The forward free ends of each of the fingers 38 carrie a jaw portion such as shown at 44. The jaw portion 44 includes an inwardly facing jaw 46 and an outer cam surface 48. This cam surface 48 extends axially and radially in a diagonal direction.

The collet member 36 is adapted to be inserted into the forward open end 30 of the forward tubular portion 24 as shown in FIG. 2. It freely enters the tubular portion 24 until the cam surface 48 of the fingers 38 engage the surface 32. In this position, the tabs 34 lie in the spaces 42 between adjacent fingers 38. As will be apparent to those skilled in the art, the interaction between the tabs 34 and the fingers 38 help to prevent the collet from turning or twisting when the driver 10 is being used.

The driver mechanism 14 also includes a thread follower 50. Thread follower 50 is comprised of a substantially flat metallic member having a thickness which is slightly less than the width of the slot 26. The thread follower 50 has a top edge 52 and a bottom edge 54. The top edge 52 has an upper pair of projections 56 and 58 extending upwardly therefrom and the bottom edge 54 has a lower pair of projections 60 and 62 extending downwardly. It can be seen that respective pairs of projections 56, 60 and 58, 62 are not in alignment with each other. Rather, they are slightly axially offset. The bottom edge 54 of the thread follower 50 also includes a leg portion 64 which extends rearwardly of the projections and then downwardly to terminate in a foot 66. As shown in FIGS. 2–5, the thread follower 50 is adapted to cooperate with the collet 36 and the closure member 18. As the collet is inserted into the open end 30 of the forward tubular member 24, the thread follower 50 is inserted down through the slot 26 into one of the openings 42 in the collet member 36. It is easily maneuvered into position wherein the leg portion 64 extends around the ring 40 so that the foot 66 and the lower projections 60 and 62 lie on either side of the ring 40. (See FIGS. 4 and 5) In this position, the upper projections 56 and 58 extend through the upper slot 26 and are exposed at the top of the intermediate tubular portion and the lower projections 60 and 62 extend downwardly through the equivalent lower slot at the bottom of the intermediate tubular member.

Figure 4:
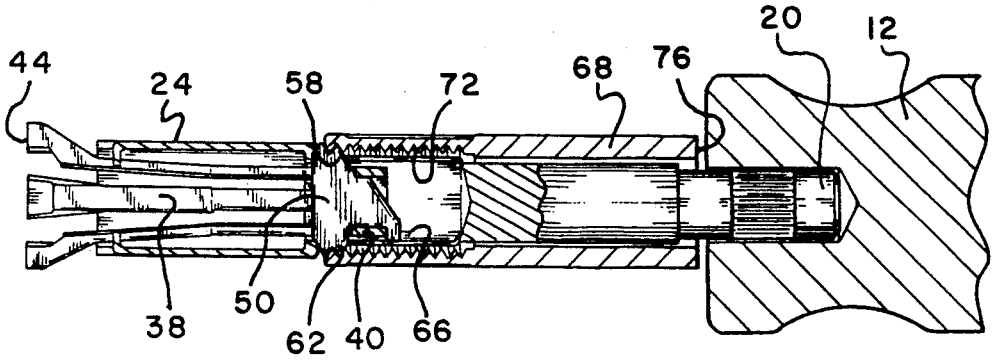
FIG. 4 is a cross-sectional view taken through the line 4—4 of FIG. 1.

With the collet 36, thread follower 50 and closure member 18 assembled as thus described, an outer tubular sleeve member 68 is then assembled onto the same over the free end of the rear shank portion 20. The forward portion 70 of the sleeve member 68 has an internal screw thread 72 on the inner surface thereof. As the sleeve member 68 is slid over the rear end of the closure member 18, it eventually engages the projections 58 and 62 of the thread follower 50. The sleeve member 68 is then rotated so that the internal screw thread 72 threads itself onto the projections 56, 58, 60 and 62 as shown in FIG. 4. The outer surface of the tubular sleeve member 68 has a knurled outer area as shown at 74 in order to make it easier for a person to grasp the sleeve and rotate the same.

With the outer tubular sleeve member 68 properly assembled onto the remaining portions of the closure member 18, the closure member is then attached to the handle 12 as discussed above. As shown most clearly in FIGS. 4 and 5, when properly assembled, the rearwardmost end 76 of the sleeve 68 loosely abuts the forward end of the handle 12. Similarly, the forwardmost end 78 of the sleeve member 68 loosely abuts the rearwardmost edge 80 of the forward tubular portion 24. As a result, the tubular sleeve member 68 cannot move forwardly or rearwardly but can only rotate.

As the sleeve 68 rotates, the projections 56, 58, 60 and 62 of the thread follower 50 ride within the internal thread 72. And since the thread follower 50 is prohibited from rotation because of the slot 26 and the spaces 42, the cam follower 50 moves axially forward or back depending on the rotation of the sleeve 68. As the thread follower moves rearwardly, it carries with it the collet 36. The cam surfaces 48 of the jaw portions 44 engage the surface 32 on the forward end 30 of the tubular portion 24 and the jaw portions move radially inwardly toward each other. Conversely, when the sleeve member 68 is rotated so that the thread follower 50 moves forwardly, the foot 66 of the thread follower 50 pushes the collet 36 forwardly. And since the fingers 38 are all biased slightly outwardly, as the jaw portions 44 exit the open forward end 30 of the outer tubular sleeve member 24, the jaws move radially away from each other.

It can be seen, therefore, that the jaw portions 44 can be adjusted to a very wide variety of different sizes by rotating the sleeve 68. Furthermore, as a result of friction between the various parts, once the jaw portions are set to a particular size, they will remain in their pre-set positions until and unless the sleeve 68 is again rotated.

Figure 5:
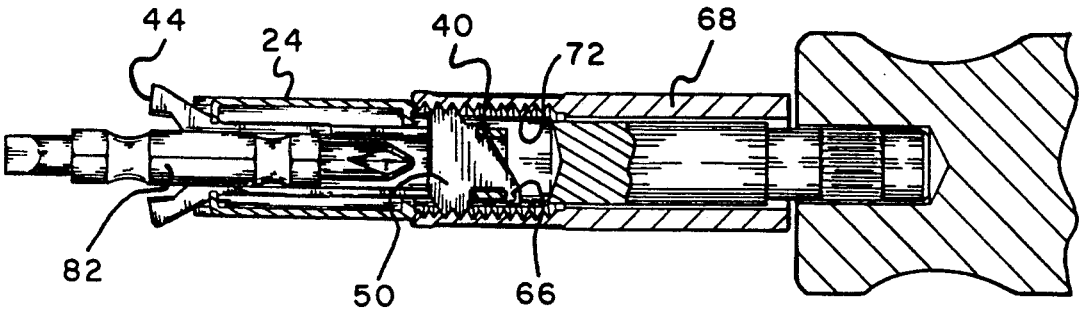
FIG. 5 is a cross-sectional view similar to FIG. 4 but showing the split collet in a slightly closed position.

The variable nut driver thus described can, therefore, be adjusted to fit substantially any size nut or screw. Furthermore, the driver can be used to both screw and unscrew devices and can grasp a screw or nut after or before it is actually being screwed or unscrewed. Even further, and as shown in FIG. 5, the variable nut driver of the present invention can be used to hold various types of screwdriver or nut driver bits such as bit 82. This is done by opening the jaws and inserting the bit 82 into the opening between the fingers. Thereafter, the sleeve 68 is rotated to close the fingers tightly onto the bit 82.

The present invention may be embodied in other specific forms without departing from the spirit or essential attributes thereof and accordingly reference should be made to the appended claims rather than to the foregoing specification as indicating the scope of the invention.

I claim:

1. A variable nut driver comprising:

a handle;

a closure member having a rear shank portion, an intermediate tubular portion having a pair of opposed elongated slots, and a forward tubular portion, the free rear end of said shank portion being secured to said handle;

an outer tubular sleeve member surrounding said intermediate tubular portion, said sleeve member having an internal screw thread on the inner surface thereof overlying said elongated slots;

a collet ember comprised of a plurality of elongated fingers and a cylindrical ring connecting said fingers at one end thereof, said fingers being separated from each other with a space interposed between adjacent fingers and including jaw portions at their free ends, said collet member being located within said tubular portions with said jaw portions extending forwardly of said forward tubular portion, and a thread follower, said thread follower engaging the cylindrical ring of said collet member so as to be axially moveable with said collet member, said thread follower including projections extending through said slots in said intermediate tubular portion and through two of said spaces in said collet member between said fingers, said projections engaging said screw thread at axially displaced positions whereby when said sleeve member is rotated, said thread follower moves axially moving said collet member therewith and moving said jaw portions toward or away form the free open end of said forward tubular portion, said thread follower being comprised of a substantially flat metallic member having a top edge and a bottom edge, an upper pair of projections extending upwardly from said two edge and a lower pair of projections extending downwardly from said bottom edge, all four of said projections engaging said internal thread, said flat metallic member further including a leg portion adjacent the bottom edge which extends rearwardly and downwardly to engage said cylindrical ring of said collet member.

2. The invention as claimed in claim 1 wherein said sleeve member extends between said handle and said forward tubular portion.

3. The invention as claimed in claim 1 wherein said fingers are spring biased radially outwardly.

4. The invention as claimed in claim 3 wherein the free ends of said fingers include cam surfaces on the radially outer surfaces thereof opposite said jaw portions, said cam surfaces engaging the forward open end of said forward tubular member whereby as said fingers are moved into said forward tubular member, said jaw portions move toward each other and as said fingers are moved out of said forward tubular member, said jaw portions move away from each other.

5. A variable nut driver comprising:

a handle;

a closure member having a rear shank portion, an intermediate tubular portion having a pair of opposed elongated slots, and a forward tubular portion, the free rear end of aid shank portion being secured to said handle;

an outer tubular sleeve member surrounding said intermediate tubular portion, said sleeve member having an internal screw thread on the inner surface thereof overlying said elongated slots;

a collet member comprised of a plurality of elongated fingers and a cylindrical ring connecting said fingers at one end thereof, said fingers being separated from each other with a space interposed between adjacent fingers and including jaw portions at their free ends, said collet member being located within said tubular portions with said jaw portions extending forwardly of said forward tubular portion, and a thread follower, said thread follower engaging the cylindrical ring of said collet member so as to be axially moveable with said collet member, said thread follower including projections extending through said slots in said intermediate tubular portion and through two of said spaces in said collet member between said fingers, said projections engaging said screw thread at axially displaced positions whereby when said sleeve member is rotated, said thread follower moves axially moving said collet member therewith and moving said jaw portions toward or away from the free open end of said forward tubular portion, said thread follower including a top edge and a bottom edge and further including a leg portion adjacent the bottom edge which extends rearwardly and downwardly to engage said cylindrical ring of said collet member.

6. The invention as claimed in claim 5 wherein said sleeve member extends between said handle and said forward tubular portion.

7. The invention as claimed in claim 5 wherein said fingers are spring biased radially outwardly.

8. The invention as claimed in claim 7 wherein the free ends of said fingers include cam surfaces on the radially outer surfaces thereof opposite said jaw portions, said cam surfaces engaging the forward open end of said forward tubular member whereby as said fingers are moved into said forward tubular member, said jaw portions move toward each other and as said fingers are moved out of said forward tubular member, said jaw portions move away from each other.

9. The invention as claimed in claim 5 wherein said thread follower is comprised of a substantially flat metallic member.

10. The invention as claimed in claim 9 wherein said flat metallic member has an upper pair of projections extending upwardly from said top edge and a lower pair of projections extending downwardly from said bottom edge, all four of said projections engaging said internal thread.

* * * * *